US009702677B2

(12) United States Patent
Balzano

(10) Patent No.: US 9,702,677 B2
(45) Date of Patent: Jul. 11, 2017

(54) AMMUNITION FOR PROVIDING A MULTILAYER FLOWERING UPON IMPACT

(71) Applicant: Alfiero Balzano, Garden Grove, CA (US)

(72) Inventor: Alfiero Balzano, Garden Grove, CA (US)

(73) Assignee: BASIC ELECTRONICS, INC., Garden Grove, CA (US)

( * ) Notice: Subject to any disclaimer, the term of this patent is extended or adjusted under 35 U.S.C. 154(b) by 0 days.

(21) Appl. No.: 14/696,956

(22) Filed: Apr. 27, 2015

(65) Prior Publication Data

US 2016/0313100 A1 Oct. 27, 2016

(51) Int. Cl.
*F42B 12/34* (2006.01)
*F42B 14/04* (2006.01)

(52) U.S. Cl.
CPC ..... *F42B 12/34* (2013.01); *F42B 14/04* (2013.01)

(58) Field of Classification Search
CPC ..... F42B 12/34; F42B 12/82; F42B 14/02; F42B 14/04; F42B 30/02; F42B 12/367
USPC ..... 102/507, 508, 509, 510, 511, 526, 527
See application file for complete search history.

(56) References Cited

U.S. PATENT DOCUMENTS 1,023,469 A * 4/1912 Haslett ..... F42B 12/34 102/510
1,096,558 A * 5/1914 Newton ..... F42B 12/34 102/508
1,154,437 A 9/1915 Rimailho
1,155,901 A * 10/1915 Duncan ..... F42B 12/34 102/508
3,598,057 A 8/1971 Potter
3,786,760 A * 1/1974 Feldmann ..... F42B 14/02 102/527
4,381,319 A * 4/1983 Hargreaves ..... B05D 7/14 102/527
4,520,731 A * 6/1985 Gotz ..... F42B 14/02 102/527
4,532,868 A * 8/1985 Gleichaut ..... F42B 14/02 102/527
4,558,646 A * 12/1985 Hoffmann ..... F42B 14/02 102/527

(Continued)

FOREIGN PATENT DOCUMENTS

FR 2867266 A1 * 9/2005 ..... F42B 12/34

*Primary Examiner* — James S Bergin
(74) *Attorney, Agent, or Firm* — Stetina Brunda Garred and Brucker

(57) ABSTRACT

The disclosed ammunition is adapted for flowering into a plurality of sections upon impact with a body or object. The ammunition comprises a cylindrical casing, a charge disposed within the cylindrical casing and cylindrical projectile, defining a first portion within the casing and a second portion extending from the casing. The projectile comprises a projectile body and projectile jacket. The projectile jacket is disposed about at least a portion of the projectile body. The projectile body and/or the projectile jacket each define a leading end and a plurality of radially arrayed score lines formed therein, extending from the leading end. Upon impact, the projectile body and/or the projectile jacket flower into a plurality of radially arrayed sections, the sections being defined by the score lines formed in the projectile body and/or the projectile jacket.

14 Claims, 2 Drawing Sheets

(56) References Cited

U.S. PATENT DOCUMENTS

| | | | | |
|---|---|---|---|---|
| 4,610,061 | A * | 9/1986 | Halverson | F42B 12/34 102/509 |
| 4,644,867 | A | 2/1987 | Hellner et al. | |
| 4,776,279 | A * | 10/1988 | Pejsa | F42B 12/34 102/510 |
| 4,781,118 | A | 11/1988 | Assmann | |
| 5,208,424 | A * | 5/1993 | Schluckebier | F42B 12/34 102/509 |
| 6,176,186 | B1 * | 1/2001 | Engel | F42B 12/34 102/506 |
| 6,182,574 | B1 | 2/2001 | Giannoni | |
| 6,805,057 | B2 | 10/2004 | Carr et al. | |
| 6,845,717 | B1 * | 1/2005 | Sauvestre | F42B 12/34 102/510 |
| 6,935,243 | B2 * | 8/2005 | Dippold | F42B 12/34 102/508 |
| 7,404,359 | B2 | 7/2008 | Muskat et al. | |
| 7,509,911 | B2 | 3/2009 | Muskat et al. | |
| 8,171,851 | B2 | 5/2012 | Siddle et al. | |
| 8,171,852 | B1 * | 5/2012 | Rebar | F42B 12/34 102/509 |
| 8,230,789 | B1 | 7/2012 | Williams et al. | |
| 8,256,352 | B2 * | 9/2012 | Masinelli | F42B 12/78 102/507 |
| 8,286,558 | B2 * | 10/2012 | Marx | F42B 14/02 102/527 |
| 9,194,676 | B1 * | 11/2015 | Masinelli | F42B 12/34 |

* cited by examiner

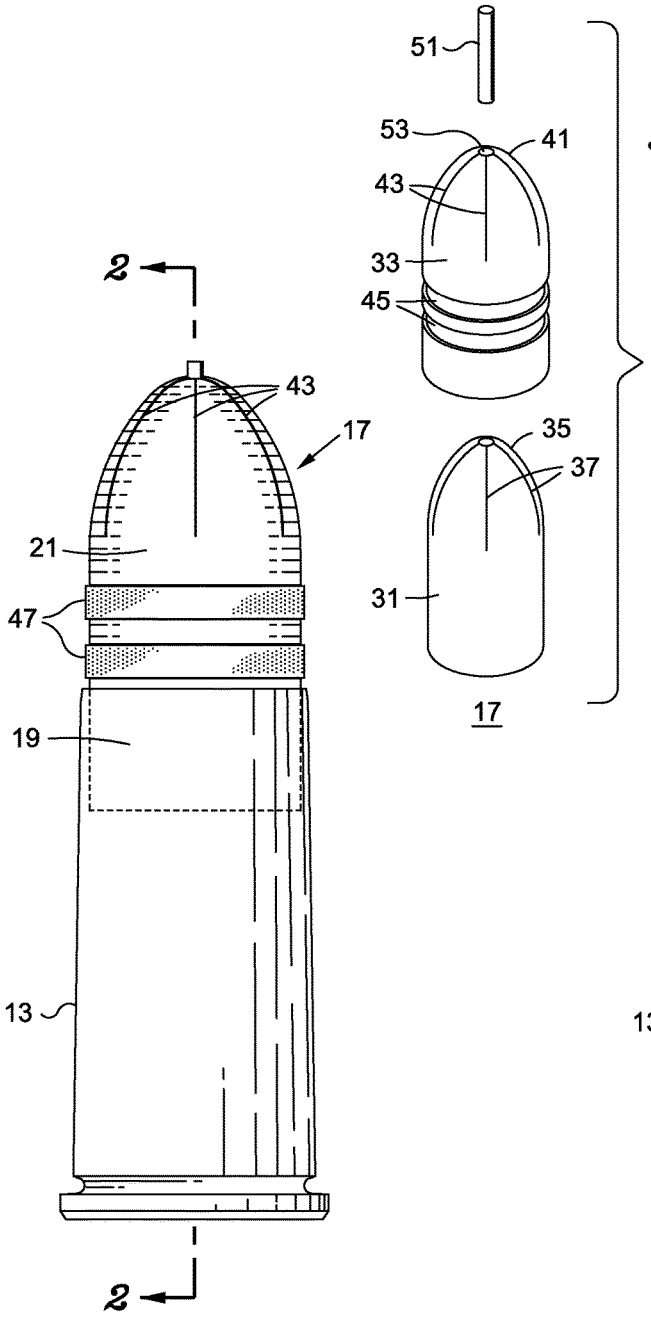
Fig. 3
Fig. 1
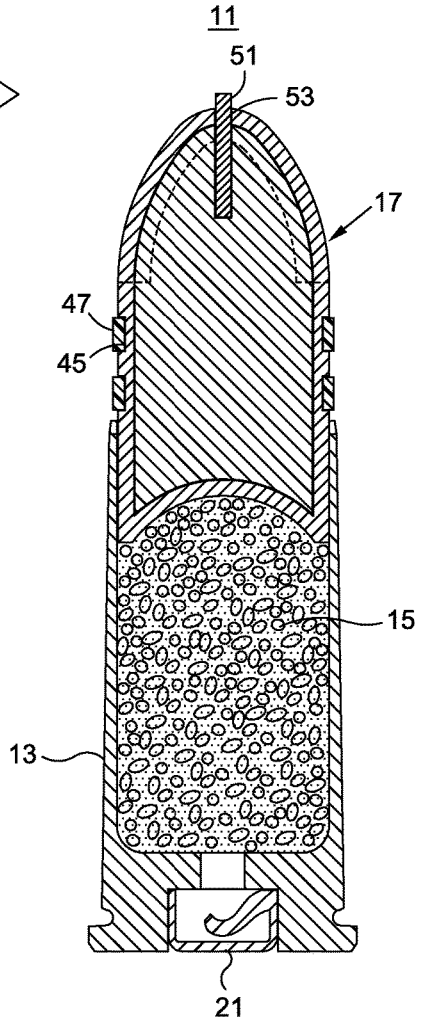
Fig. 2

AMMUNITION FOR PROVIDING A MULTILAYER FLOWERING UPON IMPACT

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to ammunition adapted to provide a high kinetic impact over a broader, to preclude an attacker from moving forward and/or destroy an object impacted by the ammunition.

Different types of ammunition serve different types of needs. One type of ammunition can be used for long range target practice. The ammunition for this purpose is preferably formed to impart high velocity and high rotational speed of the projectile discharged from the rifle or handgun barrel. The high velocity and high rotational speed serves to stabilize the flight path and accuracy over extended distances. Though such projectiles impart substantial kinetic energy to any object on which they may impact, the projectile may be more likely to travel through the object rather than imparting a high striking force over a broad area.

Some weapons, such as shot guns disperse a round of separate pellets or beads, over a broader area, but are less accurate and have shorter range. While highly effective to clear attackers from an immediate area, use of such ammunition may be ineffective to completely stop individuals from engaging and threatening activity. Military and law enforcement officers may use weapons such as shot guns to initially clear a room upon entry, followed by other personnel carrying different weapons to target specific objects or individuals more accurately, with a more concentrated force.

Various types of weapons and ammunition have been proposed which cause a spreading or fragmenting of a projectile as it leaves the gun barrel, or upon hitting a target. For example, hollow point ammunition expands to impact a high striking force over a broad area, providing a higher one-shot stop rate. However, hollow point projectiles typically have less accuracy and less overall range. Moreover, certain types of hollow point projectiles are prohibited under 1899 Geneva Convention.

Projectiles that fragment on impact may be useful for some purposes, but may lack the ability to maintain insufficient integrity to concentrate an impact force. Such projectiles may also have limited effectiveness in defeating any sort of protective equipment.

Accordingly, there is a desire to provide ammunition that can achieve high lateral speed and high rotational velocity to maintain accuracy and range, but which also can expand or flower upon impact (without fragmenting). Such ammunition is effective to concentrate the kinetic energy over a wider area to more effectively stop an attacker from moving forward and/or destroy an impacted object, i.e. have a high stopping power. Moreover, the high rotational velocity of such ammunition can produce a boring effect from the flowering projectile sections, to further enhance the stopping power/destruction power of an ammunition over the expanded area.

These and other objects and advantages are achieved by virtue of the present invention, which is described below in more detail in connection with the illustrated embodiments. As will be apparent to those skilled in the art, the present invention may be implemented in additional, alternate embodiments that also incorporate the broader scope and spirit of the present invention. As such, the embodiments described herein are intended to be exemplary, and not limiting.

BRIEF SUMMARY

The disclosed ammunition is adapted for flowering into a plurality of sections upon impact with a body or object. The ammunition comprises a cylindrical casing, a charge disposed within the cylindrical casing and cylindrical projectile, defining a first portion within the casing and a second portion extending from the casing. The projectile comprises a projectile body and projectile jacket. The projectile jacket is disposed about at least a portion of the projectile body. The projectile body and/or the projectile jacket define a leading end and a plurality of radially arrayed score lines formed therein, extending from the leading end. Upon impact, the projectile body and/or the projectile jacket flower into a plurality of radially arrayed sections, the sections being defined by the score lines formed in the projectile body and/or the projectile jacket.

In one embodiment, the projectile jacket defines a least one circumferential groove and at least one lubricating ring disposed about the projectile jacket, within the circumferential groove. The lubricating ring(s) is sized to mitigate frictional contact between the projectile and a gun barrel, and lubricate the gun barrel, as the projectile passes therethrough. The lubricating ring(s) functions to increase projectile lateral speed and rotational speed as the projectile exits the gun barrel. Consequently, upon impact the projectile body sections and the projectile jacket sections rotate during flowering to facilitate boring of the projectile into the impacted body or object.

The lubricating ring(s) may be formed of a variety of different materials such as polytetrafluoroethylene (PTFE), fluor ethylene propylene, or polyimide. In one embodiment the projectile body score lines and the projectile jacket score lines are separately formed. In another embodiment, the projectile body score lines and the projectile jacket score lines are formed simultaneously.

The length and the design of the score lines may be varied in a variety of respects. In one embodiment, the projectile body score lines are approximately one half inch long and the projectile jacket score lines are approximately one quarter inch long.

In another embodiment, the projectile defines a projectile leading end and a cylindrical hollow extending into the projectile, from the projectile leading end. A prong is provided which has a first portion disposed within the cylindrical hollow and a second portion extending outwardly therefrom. Upon impact the prong is urged into the projectile, further facilitating flowering of the projectile body and/or the projectile jacket into a plurality of sections.

In one embodiment the projectile is formed of lead and the projectile jacket is formed of copper.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 1 is a side view of an exemplary ammunition in accordance with the present invention;

FIG. 2 is a cross sectional view of the ammunition shown at FIG. 1;

FIG. 3 is an exploded view of the projectile shown at FIGS. 1 and 2;

DETAILED DESCRIPTION

Figure 4:
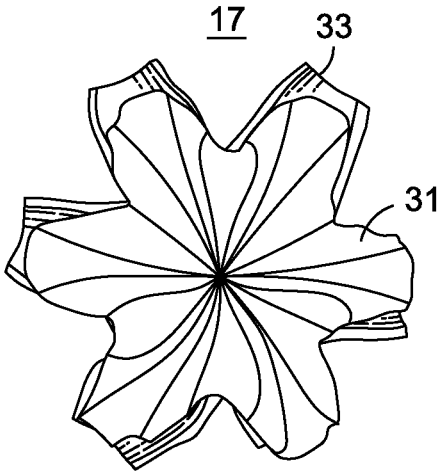
FIG. 4 is a front end view of the projectile shown at FIG. 3, after the projectile has impacted an object.

Referring to FIGS. 1-3 of the drawings, exemplary ammunition 11 is illustrated. The ammunition 11 includes a cylindrical casing 13, a charge 15 disposed within the cylindrical casing and a cylindrical projectile 17. Charge 15 is fired by detonator 21. The projectile 17 defines a first portion 19 disposed within the casing 13 and a second portion 21 extending from the casing.

As shown at FIG. 3, the projectile 17 comprises a projectile body 31 and projectile jacket 33. The projectile jacket 33 is disposed about at least a portion of the projectile body 31. In one embodiment the projectile body 31 is formed of lead and projectile jacket 33 is formed of copper.

The projectile body 31 defines a projectile body leading end 35 and a plurality of radially arrayed score lines 37 formed in the projectile body 31, extending along a portion of the projectile body from the projectile body leading end 35. Similarly, the projectile jacket 33 defines a projectile jacket leading end 41 and a plurality of radially arrayed score lines 43 formed in the projectile jacket, extending along a portion of the projectile jacket from the projectile jacket leading end 41.

The projectile jacket 33 may also define one or more circumferential grooves 45 extending about the projectile jacket 33. As shown at FIG. 1, a lubricating ring(s) 47 may be disposed about the projectile jacket 33, within the circumferential groove(s) 45. The lubricating ring(s) 47 mitigate frictional contact between the projectile and a gun barrel, through which the projectile passes when the ammunition is fired. The ammunition and the lubricating ring(s) is sized to pass through and lubricate the gun barrel when the ammunition is fired.

The lubricating ring(s) 47 causes increase projectile lateral speed and rotational speed as the projectile exits the gun barrel. As a result of the increased lateral and rotational speed of the projectile, the overall range and accuracy of the projectile may be enhanced.

The presently preferred embodiment, the lubricating ring(s) is formed of polytetrafluoroethylene (PTFE). In other embodiments, the lubricating ring(s) 47 may be formed of fluor ethylene propylene or polyimide. In some embodiments the lubricating ring(s) may be reinforced with fiberglass.

As previously noted, the projectile 17 is preferably formed to include score lines formed in the projectile body 31 and/or in the projectile jacket 33. The score lines facilitate expanding, or flowering of the projectile jacket 33 and the projectile body 31 upon impact with a body or other object.

Figure 5:
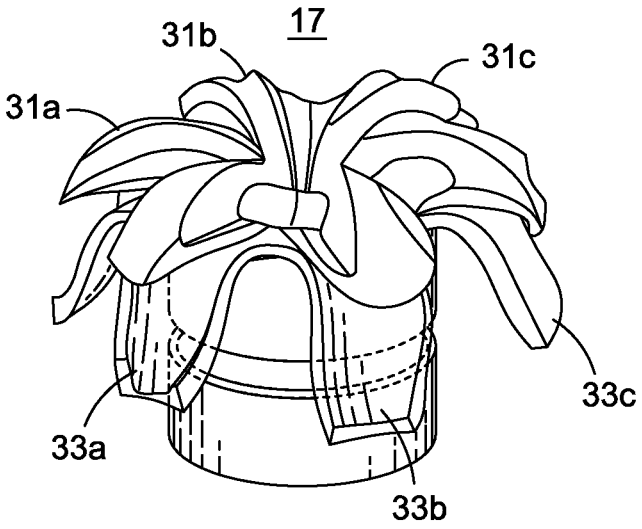
FIG. 5 is a side view of the projectile shown at FIG. 3, after the projectile has been impacted an object.

FIGS. 4 and 5 illustrate the flowering of projectile 17 when it impacts a body or object. As shown therein, the outer projectile jacket 33 flowers into sections 33*a*, 33*b*, and 33*c* defined by the score lines 43 formed in the projectile jacket 33. Similarly, the projectile body 31 flowers into sections 31*a*, 31*b*, and 31*c*, in accordance with the score lines 37 formed in the projectile body 31. As it will be apparent to one of ordinary skill in the art, the number of sections, and the particular shape thereof, can be modified in accordance with the size and shape of the score lines formed in the projectile jacket 33 and/or the projectile body 31.

In the presently preferred embodiment, score lines 37 on projectile body 31 are formed prior to the formation of projectile jacket 33 about projectile body 31. In that embodiment, the score lines 43 in the projectile jacket 33 separately formed, e.g. either prior to application of the jacket 33 to the projectile 31, or after the projectile 17 is fully formed, without extending through the projectile jacket 33.

In another embodiment the projectile jacket score lines 43 may be formed to extend through the projectile jacket 33, to also score the projectile body 31, i.e. the score lines 37 and 43 may be simultaneously formed after the projectile body 31 and projectile jacket 33 are combined.

As one of ordinary skill will recognize the score lines 37, 43 may be formed using different techniques, the result of which is to define an expanding or flowering pattern that expands the area impacted by the projectile, to provide greater stopping force while keeping the projectile intact.

The length of the projectile score lines may be varied in accordance with the desired flowering effect intended to be achieved. In the presently preferred embodiment, the projectile body score lines 37 extend approximately one half inch long and the projectile jacket score lines 43 are shorter, i.e. one quarter inch long.

In one embodiment projectile 17 includes a prong 51 (shown at FIGS. 1-3) which partially extends into a cylindrical hollow 53, formed through a portion of projectile body 31 and projectile jacket 33. Upon impact, the prong 51 is urged into the projectile 17, further facilitating flowering of the projectile body and/or the projectile jacket into the plurality of sections, as described above. In one embodiment, the cylindrical hollow 53 and the prong 51 are each threaded for mutual engagement.

It is also to be recognized that the use of the lubricating ring(s) enhances the lateral and rotational speed of the projectile as it exits the gun barrel and the action of the projectile upon impact. More specifically, the increased rotational speed of the projectile causes the projectile to rotate as it flowers and in some cases continuing after flowering, such that upon impact the projectile body sections and the projectile jacket sections facilitate boring of the projectile into an impacted body or object.

In addition to enhancing the lethality of ammunition to attackers, the rotation of the flowering projectile may also be useful to destroy an impacted objected. Because the ammunition described herein retains structural integrity, the impact of the projectile is concentrated which, in combination with the expansion and rotation of the ammunition as it impacts, provides effects that may be useful in a variety of circumstances that conventional ammunition may not achieve, e.g. to blow off door hinges, facilitating entry into a particular room.

Accordingly, the desired expansion or flowering of the projectile upon impact may be effected by variety of different factors, including the size and shape of the projectile, the charge the used to fire the projectile, the addition of lubricating ring(s) about the projectile, the manner in which the score lines are formed in the projectile jacket, and/or the projectile body and the inclusion of the prong or similar device to further facilitate the flowering or expansion of the projectile upon impact.

The above description is given by way of example, and not limitation. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. Ammunition adapted for flowering into a plurality of sections upon impact with a body or object, the ammunition comprising:

a cylindrical casing;

a charge disposed within the cylindrical casing; and a cylindrical projectile defining a first portion disposed within the casing and a second portion extending from the casing, the projectile comprising a projectile body and projectile jacket, the projectile jacket being disposed about at least a portion of the projectile body;

the projectile body defining a projectile body leading end, the projectile body leading end defining a circumference, the projectile body defining a hollow core extending longitudinally from the circumference toward an opposite end of the projectile body, the hollow core having a closed end, the closed end defining a circumference, and the projectile body defining a plurality of radially arrayed score lines formed in the projectile body, the plurality of the radially arrayed score lines extending along a portion of the projectile body from the projectile body leading end;

the projectile jacket comprising an exterior surface portion defined by a plurality of radially arrayed score lines, the plurality of radially arrayed score lines extending from a circumference of a projectile jacket opening longitudinally toward a base of the cylindrical projectile, along the projectile jacket exterior surface, to a circumference on a perimeter of the projectile jacket exterior surface proximal of a projectile jacket leading edge, the exterior surface portion defining a convex surface, and the plurality of radially arrayed score lines extending through the projectile jacket to the projectile body;

wherein the projectile jacket opening defines a projectile jacket leading edge, the circumference on a perimeter defines a common base of the sections, and the circumference of the projectile jacket opening, the circumference of the leading end of the projectile body, and the circumference of the closed end are equal;

wherein upon impact, the projectile body and the projectile jacket each flower in sections, connected only by the common base of the sections, radially outward into a plurality of radially arrayed sections, the sections being defined by the score lines formed in the projectile body and the projectile jacket.

2. The Ammunition of claim 1, further comprising a prong having a first end on a first portion disposed within the cylindrical hollow core, and a second portion extending outwardly therefrom, and wherein upon impact the prong is urged into the projectile, facilitating flowering of the projectile body and the projectile jacket into the plurality of sections;

wherein the first end of the prong is in contact with the closed end of the cylindrical hollow core.

3. The Ammunition of claim 2, wherein the projectile jacket is not attached to the prong.

4. The Ammunition of claim 1, further comprising a cylindrical prong within the hollow core, the cylindrical prong in contact with the closed end.

5. The ammunition of claim 1, wherein the projectile jacket opening defines a diameter, the leading end of the projectile body defines a diameter, and the closed end defines a diameter, and the diameter of the projectile jacket, the leading end of the projectile body, and the closed are all equal.

6. Ammunition adapted for flowering into a plurality of sections upon impact with a body or object, the ammunition comprising:

a prong;

a casing;

a projectile disposed at least in part in the casing, the projectile comprising a projectile body and projectile jacket, the projectile jacket being disposed about at least a portion of the projectile body;

the projectile body defining a hollow core extending longitudinally from a projectile body opening, the projectile body opening defining a projectile body leading end, toward an opposite end of the projectile body, and the hollow core having a closed end opposite the projectile body opening, and the projectile body defining a plurality of radially arrayed score lines formed in the projectile body, the plurality of radially arrayed score lines extending along a portion of the projectile body from the projectile body leading end;

the projectile jacket comprising an exterior surface portion including a plurality of radially arrayed score lines, the plurality of radially arrayed score lines extending from a projectile jacket opening, longitudinally toward a base of the cylindrical projectile, to a circumference on a perimeter of the projectile jacket exterior surface proximal of the projectile jacket opening, the plurality of radially arrayed score lines extending through the projectile jacket to the projectile body, and the projectile jacket opening defining a projectile leading edge;

wherein the circumference on a perimeter defines a common base of the sections, and wherein the prong is in abutting contact with the projectile jacket opening, the projectile body opening, and the closed end;

wherein upon impact, the projectile body and the projectile jacket each flower in sections, connected only by the common base of the sections, radially outward into a plurality of radially arrayed sections, the sections being defined by the score lines formed in the projectile body and the projectile jacket.

7. The ammunition of claim 6, wherein the prong extends distally and proximally from the projectile jacket opening.

8. The ammunition of claim 6, wherein the hollow core defines a length and a circumference, and the circumference is constant for the entire length.

9. The ammunition of claim 6, wherein the prong is cylindrical and defines a diameter, and the projectile jacket opening defines a diameter, the projectile body hollow core defines a diameter, and wherein the prong diameter, the projectile jacket opening diameter, and the projectile body hollow core diameter are substantially equal.

10. Ammunition adapted for flowering into a plurality of sections upon impact with a body or object, the ammunition comprising:

a cylindrical casing;

a charge disposed within the cylindrical casing; and a cylindrical projectile defining a first portion disposed within the casing and a second portion extending from the casing, the projectile comprising a projectile body and projectile jacket, the projectile jacket being disposed about at least a portion of the projectile body;

the projectile body defining a hollow core extending longitudinally from an opening defining a leading end of the projectile body toward an opposite end of the projectile body, and the hollow core having a closed end opposite the opening defining the leading end of the projectile body, and the projectile body defining a plurality of radially arrayed score lines formed in the projectile body, the plurality of radially arrayed score lines extending along a portion of the projectile body from the projectile body leading end;

the projectile jacket comprising an exterior surface portion including a plurality of radially arrayed score lines, the plurality of radially arrayed score lines extending from a projectile jacket opening, longitudinally toward a base of the cylindrical projectile, to a circumference on a perimeter of the projectile jacket exterior surface proximal of a projectile jacket leading edge, the plurality of radially arrayed score lines extending through the projectile jacket to the projectile body, and the projectile jacket leading edge defining a projectile leading edge;

wherein the circumference on a perimeter defines a common base of the sections, and wherein the projectile leading edge, the opening defining a leading end of the projectile body, and the closed end define a common bore, and the common bore defines a cylinder along the entire length of the common bore;

wherein upon impact, the projectile body and the projectile jacket each flower in sections, connected only by the common base of the sections, radially outward into a plurality of radially arrayed sections, the sections being defined by the score lines formed in the projectile body and the projectile jacket.

11. The ammunition of claim 10, further comprising a prong.

12. The ammunition of claim 11, wherein the prong is in abutting contact with the projectile jacket opening.

13. The ammunition of claim 12, wherein the prong is in abutting contact with the closed end.

14. The ammunition of claim 11, wherein the prong is cylindrical and defines a diameter, and the common bore defines a diameter, and the diameter of the prong, and the diameter of the common bore are substantially equal.

* * * * *